US006267634B1

(12) United States Patent
Ewald et al.

(10) Patent No.: US 6,267,634 B1
(45) Date of Patent: Jul. 31, 2001

(54) PROPELLER FLARE

(75) Inventors: Michael J. Ewald, Kenosha, WI (US); Daniel J. Kreul; Cy Gerard Werda, both of Winthrop Harbor, IL (US)

(73) Assignee: Outboard Marine Corporation, Waukegan, IL (US)

( * ) Notice: Subject to any disclaimer, the term of this patent is extended or adjusted under 35 U.S.C. 154(b) by 0 days.

(21) Appl. No.: 09/390,880

(22) Filed: Sep. 7, 1999

(51) Int. Cl.[7] ..... B63H 21/32
(52) U.S. Cl. ..... 440/89; 416/93 A
(58) Field of Search ..... 416/93 A, 93 R; 440/49, 89

(56) References Cited

U.S. PATENT DOCUMENTS

| | | | | |
|---|---|---|---|---|
| 2,948,252 | | 8/1960 | Alexander, Jr. . | |
| 3,356,151 | | 12/1967 | Strang . | |
| 3,542,487 | * | 11/1970 | Knuth | 416/93 A |
| 3,589,833 | * | 6/1971 | Lancioni | 416/93 A |
| 3,876,331 | * | 4/1975 | DenHerder et al. | 416/93 A |
| 5,158,433 | | 10/1992 | Cleary . | |
| 5,368,508 | * | 11/1994 | Whittington | 440/49 |
| 5,527,195 | | 6/1996 | Neisen . | |

* cited by examiner

*Primary Examiner*—Stephen Avila
(74) *Attorney, Agent, or Firm*—Armstrong Teasdale LLP

(57) ABSTRACT

A propeller flare having a periodic shape and extending from the aft end of the propeller hub is described. The periodic shape of flare provides that the trailing edge, or aft end, of the propeller hub is increased only at locations where such increased material is needed to prevent exhaust gases from reaching the lower pressure region on the suction side of the blades. By only increasing the hub aft end at such selected locations, the efficiency and speed loss due to increased drag is minimized. In one embodiment, the flare is configured for a three blade propeller and includes three flare sections. Each flare section has a helical cross-sectional shape, and ramps are located intermediate adjacent flare sections. Each ramp is aligned with one of the propeller blades, and each ramp has a pitch at least about equal to the pitch of blades. Reliefs are located adjacent each ramp, and each relief extends from an aft end of the ring toward a fore end of the ring. Each ramp has a thrust surface, and the thrust surfaces align with each blade position and angle. The reliefs allow some bleed through of the exhaust gases, and the thrust surfaces provide thrust enhancement during engine operation. The ramps provide a local pressure increase and obstruct exhaust gases from entering into the propeller blades.

38 Claims, 4 Drawing Sheets

PROPELLER FLARE

BACKGROUND OF THE INVENTION

The invention relates generally to engines, and more particularly, to apparatus for preventing exhaust gases from flowing back into a propeller hub.

Outboard engines include an exhaust casing extending from a power head, and a lower unit secured to the exhaust casing. The lower unit includes a gear case which supports a propeller shaft, and a propeller is engaged to the shaft. The propeller includes an outer hub through which exhaust gases are discharged.

During operation, a region of low pressure is developed rearwardly of the propeller. A thin low pressure boundary layer around the hub can also develop. The low pressure condition rearwardly of the hub has a tendency to join with the low pressure boundary layer, and exhaust gas migrates forwardly along the propeller hub between the blades and along the front face of the propeller blades, thereby causing conditions of "cavitation" or "ventilation". Such conditions of cavitation prevent the propeller blade from biting into the water and result in an efficiency loss. In addition, excessively low pressure in the region rearwardly of the propeller hub results in a drag on the forward movement of the engine through the water.

Known propeller structures for preventing ventilation include diverging flare rings and converging rings at the rear end of the propeller hub. The rings affect the flow of water over the hub and prevent migration of the exhaust gases along the hub. Although the known ring configurations are effective in preventing ventilation, such rings can cause efficiency and speed loss due to increased drag.

It would be desirable to provide apparatus that is as effective as the known structures for preventing ventilation, yet avoid the efficiency and speed losses associated with such known structures.

BRIEF SUMMARY OF THE INVENTION

These and other objects may be attained by a propeller flare having a periodic shape and configured for being secured to the aft end of the propeller hub. The periodic shape of the flare provides that the trailing edge, or aft end, of the propeller hub is increased only at locations where exhaust gases must be blocked from reaching the lower pressure region on the suction side of the blades. By only increasing the hub aft end at such selected locations, the efficiency and speed loss due to increased drag is minimized.

More particularly, and in one embodiment, the flare is configured for a three blade propeller and includes three flare sections. Each flare section has a helical cross-sectional shape, and ramps are located intermediate adjacent flare sections. Each ramp is aligned with one of blades, and each ramp has a pitch at least about equal to the pitch of blades. Reliefs are located adjacent each ramp, and each relief extends from an aft end of the ring toward a fore end of the flare.

Each ramp has a thrust surface, and the thrust surfaces align with each blade position and angle. The reliefs allow some bleed through of the exhaust gases, and the thrust surfaces provide thrust enhancement during engine operation. The ramps provide a local pressure increase and obstruct exhaust gases from entering into the propeller blades.

DETAILED DESCRIPTION OF THE INVENTION

The present invention is not limited to practice in connection with a particular engine, nor is the present invention limited to practice with a particular propeller configuration. The present invention can be utilized in connection with many engines and propeller configurations. For example, a propeller having three blades is described herein. The present invention, however, can be used in connection with propellers having any number of blades. Therefore, although the invention is described below in the context of an exemplary outboard engine and propeller configuration, the invention is not limited to practice with such engine and propeller.

In addition, the specific embodiment described herein is in the form a ring that attaches to a propeller hub. The flare, however, can be integral with the propeller hub rather than as a separate flare ring. The present invention, therefore, is not limited to practice as a separate flare ring, but also includes a flare integral with the hub.

Figure 1:
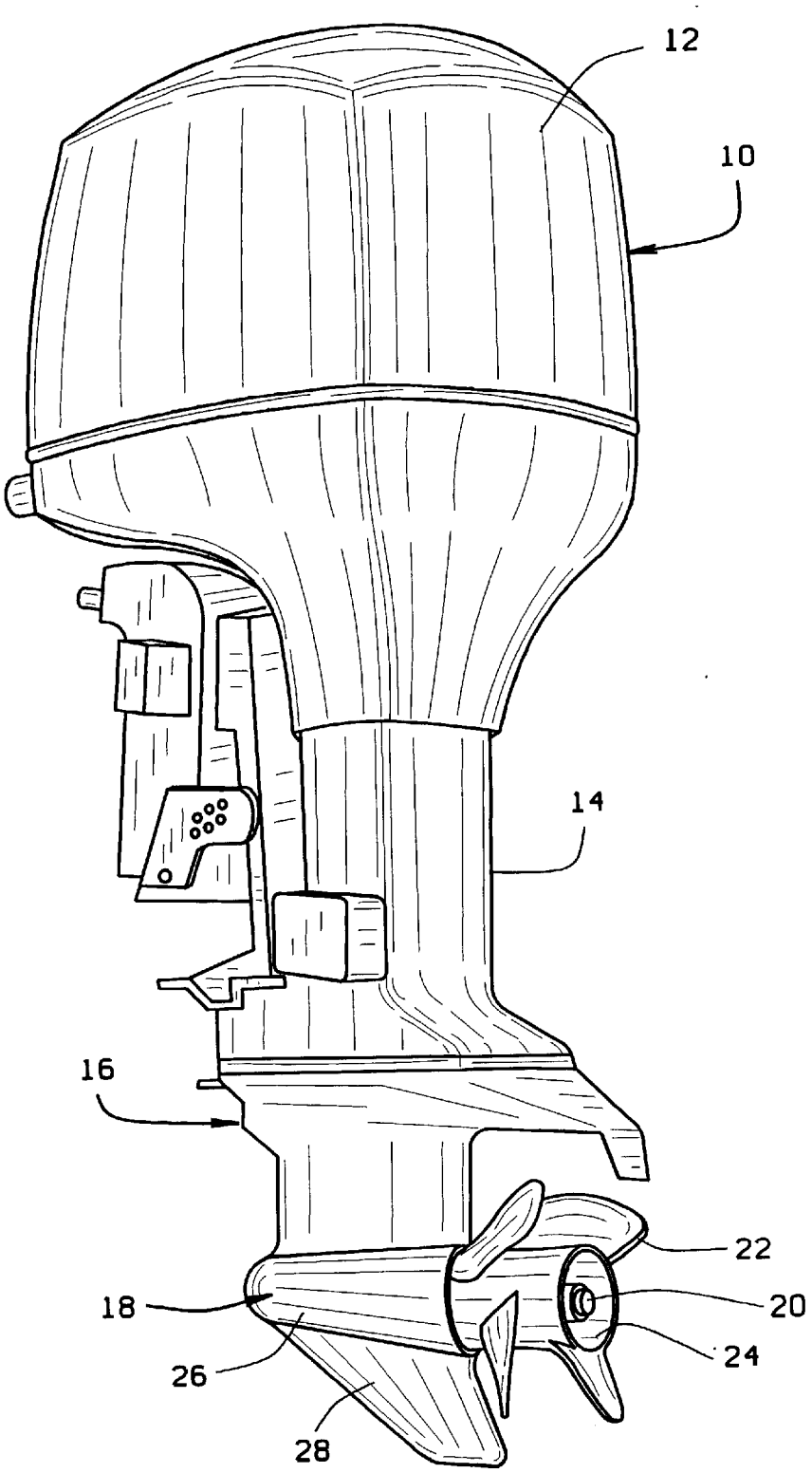
FIG. 1 is a perspective view of an outboard engine.

Referring now particularly to the drawings, FIG. 1 is a perspective view of an exemplary outboard engine, such as an outboard engine commercially available from Outboard Marine Corporation, Waukegan, Ill. Engine 10 includes a cover 12 which houses a power head (not shown), an exhaust housing 14, and a lower unit 16. Lower unit 16 includes a gear case 18 which supports a propeller shaft 20. A propeller 22 is engaged to shaft 20. Propeller 22 includes an outer hub 24 through which exhaust gas is discharged. Gear case 18 includes a bullet, or torpedo, 26 and a skeg 28 which depends vertically downwardly from torpedo 26.

As explained above, and during operation, a region of low pressure develops rearwardly of propeller 22, and a thin low pressure boundary layer forms around propeller hub 24. The low pressure condition rearwardly of propeller 22 may join with the low pressure boundary layer, which results in exhaust gas migration forwardly along propeller hub 24 between the propeller blades and along the front face of the propeller blades thereby causing ventilation. Such ventilation prevents the propeller blades from biting into the water. In addition, if excessively low pressure is developed in the region rearwardly of propeller hub 24, such excessive low pressures can also result in a drag on the forward movement of engine 10 through the water.

Figure 2:
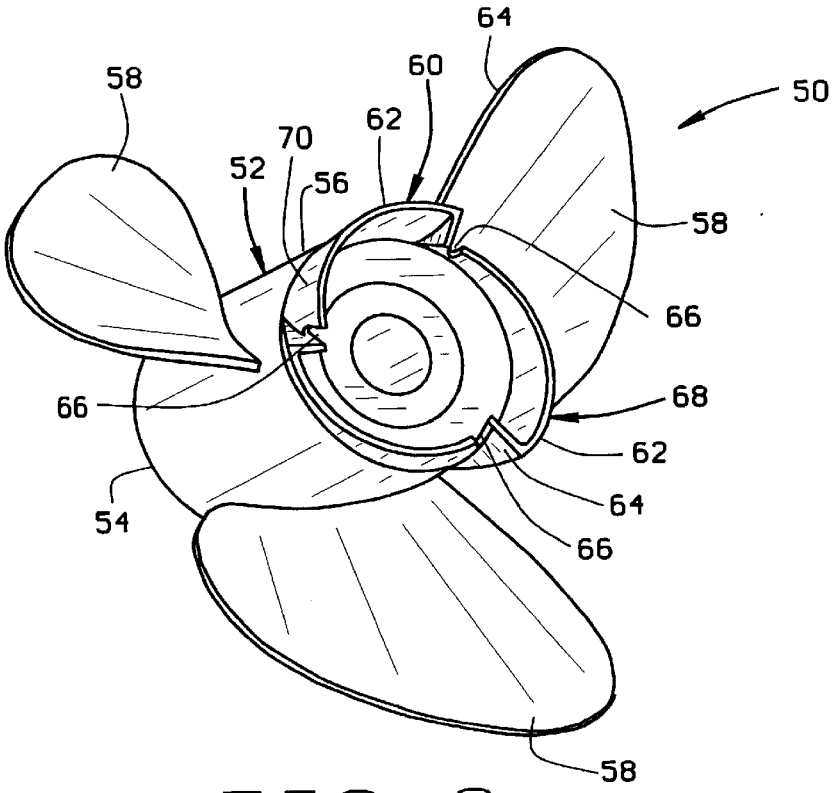
FIG. 2 is a perspective view of a propeller constructed in accordance with one embodiment of the present invention.

FIG. 2 is a perspective view of a propeller 50 constructed in accordance with one embodiment of the present invention. Propeller 50 includes a center hub 52 having a fore end 54 and an aft end 56. A plurality of blades 58 extend from center hub 52, and a flare ring 60 extends from center hub aft end 56. Again, the flare illustrated by flare ring 60 can, alternatively, be cast integral with hub 52.

The flare of ring 60 has a periodic shape. Particularly, the flare is formed by flare sections, or wings, 62, and each flare section 62 has a helical cross-sectional shape. Ramps 64 are located intermediate adjacent flare sections 62, and each ramp 64 is aligned with one of blades 58. Each ramp 64 has a pitch at least about equal to the pitch of blades 58. For example, if propeller blades 58 have a pitch of 19, then ramps 64 also have a pitch of 19. Reliefs 66 are located adjacent each ramp 64, and each relief 66 extends from an aft end 68 of ring 60 toward a fore end 70 of ring 60.

Figure 3:
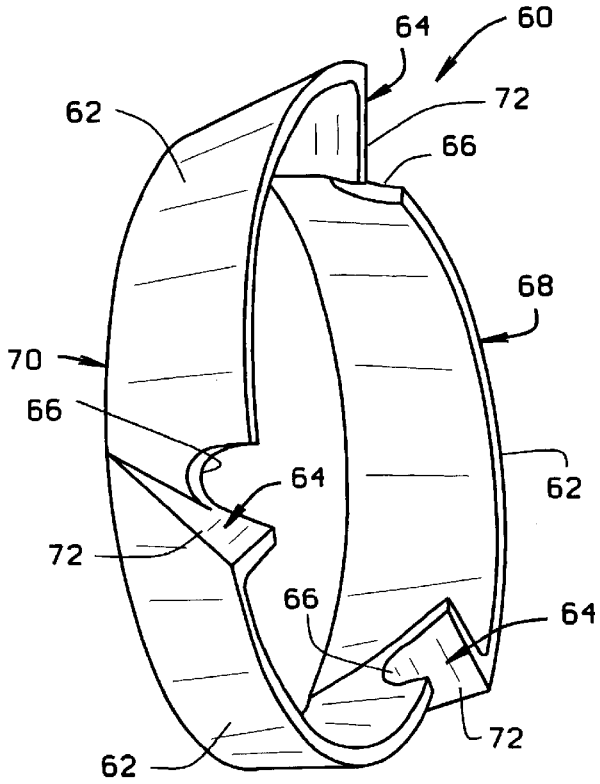
FIG. 3 is a perspective view of the flare ring shown in FIG. 2.

FIG. 3 is a perspective view of flare ring 60 shown in FIG. 2. As shown in FIG. 3, each ramp 64 has a thrust surface 72. Thrust surfaces 72 align with each blade position and angle, and provide thrust enhancement during operation. Ramps 64 also provide a local pressure increase and obstruct exhaust gases from entering into propeller blades 58.

Figure 4:
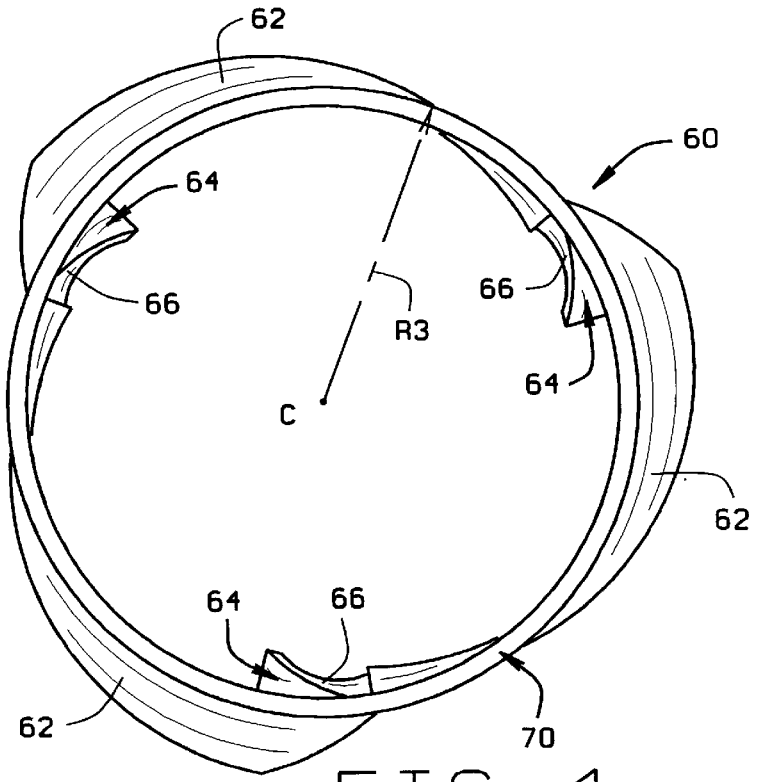
FIG. 4 is a front view of the flare ring shown in FIG. 3.
Figure 5:
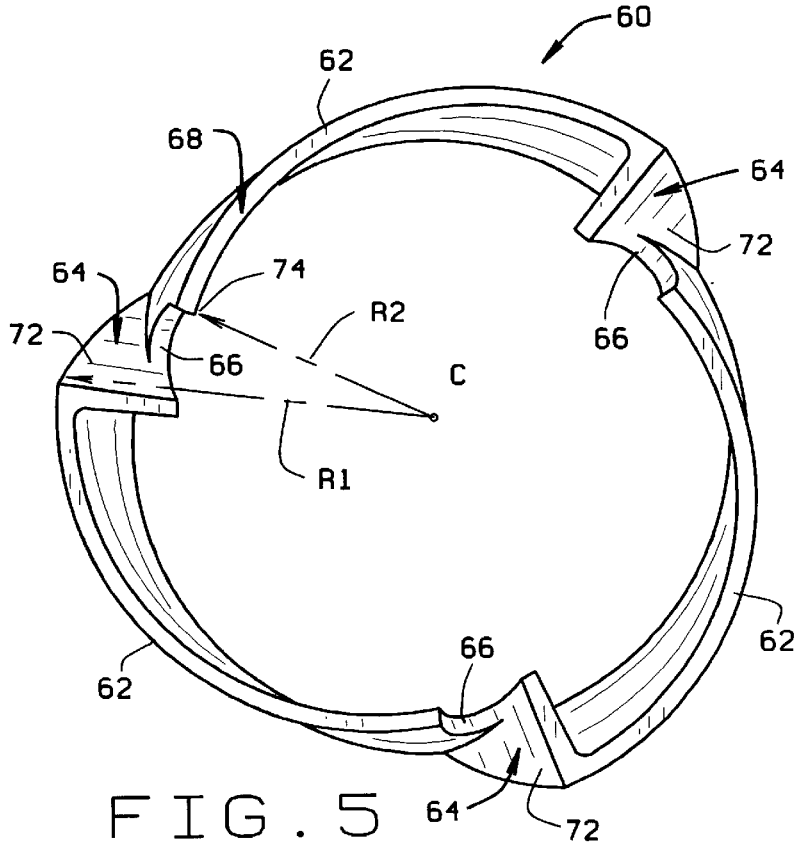
FIG. 5 is a rear view of the flare ring shown in FIG. 3.

Referring to FIGS. 4 and 5, which are front and rear views, respectively, of flare ring 60. Generally, the flare of ring 60 increases the trailing edge hub diameter only where such increases are needed to prevent exhaust gases from reaching the lower pressure region on the suction side of blades. Ring 60 provides a variable hub radius and/or length at or near the trailing edge, or aft end, of the hub.

More specifically, flare ring 60 has a first radius R1 (FIG. 5) measured at ring aft end 68 from a center C of ring 60 to an outer diameter of ring 60 at ramp 64. Ring 60 also has a second radius R2 (FIG. 5) measured at ring aft end 68 from ring center C to an outer diameter of ring 60 at an edge 74 of relief 66 opposite ramp 64. Radius R1 is greater than radius R2. Helical shaped flare sections 62 smoothly transition from first radius R1 to second radius R2. First radius R1 is also greater than a radius R3 (FIG. 4) measured at ring fore end 70 from ring center C to an outer diameter of ring 60.

Figure 6:
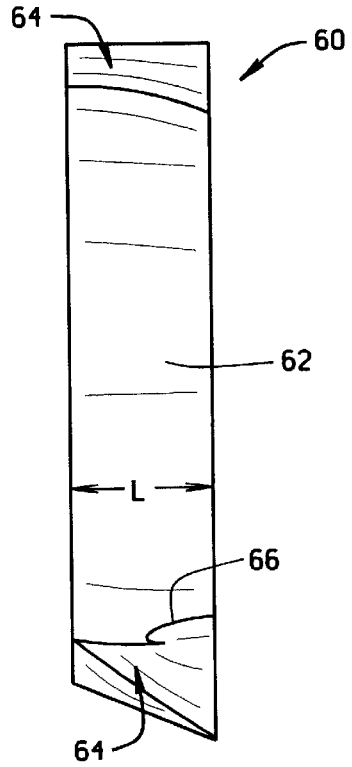
FIG. 6 is a side view of the flare ring shown in FIG. 3.

FIG. 6 is a side view of flare ring 60 shown in FIG. 3. In one specific embodiment, each flare section 62 has a length of about 1 inch. Flare ring 60 can be cast, for example, from 431 stainless steel using known casting techniques. After fabricating, ring 60 can be secured to a propeller hub. Particularly, ramps 64 are aligned with respective blades, and then fore end 70 (shown in FIG. 3) of ring 60 is secured to aft end 56 (shown in FIG. 2) of hub 52 (shown in FIG. 2). For example, fore end 70 of ring 60 is welded to aft end 56 of hub 52.

Figure 7:
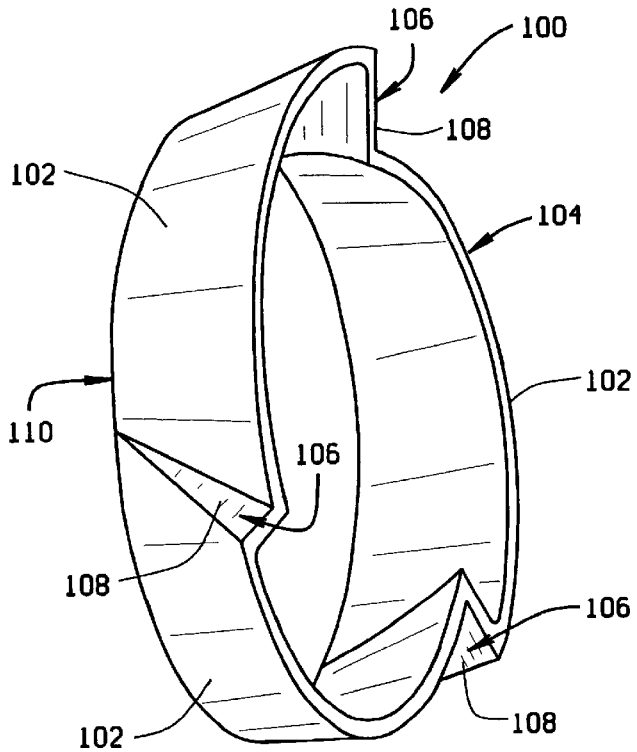
FIG. 7 is a perspective view of an alternate embodiment of a flare ring in accordance with the present invention.

FIG. 7 is a perspective view of an alternate embodiment of a flare ring 100. Ring 100 has a periodic shape and includes flare sections 102. Each flare section 102 has a helical cross-sectional shape. Ramps 106 are located intermediate adjacent flare sections 102, and each ramp 106 is configured to be aligned with one of blades 58 (shown in FIG. 2). Each ramp 106 has a pitch at least about equal to the pitch of blades 58. For example, if propeller blades 58 have a pitch of 19, then ramps 106 also have a pitch of 19. Each ramp 106 has a thrust surface 108 which extends from aft end 104 toward a fore end 110 of ring 100. Thrust surfaces 108 align with each blade position and angle, and provide thrust enhancement during operation. Ramps 106 also provide a local pressure increase and obstruct exhaust gases from entering propeller blades 58.

Ring 100 has the same dimensions as flare ring 60. Ring 100, however, does not include reliefs 66. Generally, ring 100 increases the trailing edge hub diameter only where such increases are needed to prevent exhaust gases from reaching the lower pressure region on the suction side of blades 58.

Rings 60 and 100 can be modified for use with many different propellers. For example, the number of wings and ramps of the ring typically are selected to match the number of blades of the particular propeller. For example, a ring for a five blade propeller includes five wings and five ramps.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. A propeller comprising a flare, said flarering comprising a fore end, a plurality of flare sections extending from said fore end, each said flare section having a helical cross-sectional shape.

2. A propeller in accordance with claim 1 wherein said flarering comprises a first flare section and a second flare section, a ramp intermediate said first and second flare sections, said ramp extending from said fore end.

3. A propeller in accordance with claim 2 further comprising at least one blade having a pitch, and wherein said ramp has a pitch at least about equal to said propeller blade pitch.

4. A propeller in accordance with claim 3 wherein said ramp is aligned with the propeller blade.

5. A propeller in accordance with claim 2 wherein said flarering further comprises a relief adjacent said ramp, said relief extending from an aft end of said flare toward said fore end.

6. A propeller in accordance with claim 2 wherein said flarering further comprising a first radius measured at an aft end thereof from a center of said flarering to an outer diameter of said flare at said ramp, and a second radius measured at said flare aft end from said flare center to an outer diameter of said flare at an edge of said relief opposite said ramp.

7. A propeller in accordance with claim 6 wherein said first radius is greater than said second radius.

8. A propeller in accordance with claim 6 wherein said first radius is greater than a radius measured at said flare fore end from said flare center to an outer diameter of said flare.

9. A propeller in accordance with claim 1 wherein said flarering comprises a first flare section, a second flare section, and a third flare section, a first ramp intermediate said first and second flare sections, a second ramp intermediate said second and third flare sections, and a third ramp intermediate said third and first flare sections.

10. A propeller comprising:

a center hub comprising a fore end and an aft end;

a plurality of blades extending from said center hub; and a flare extending from said center hub aft end, said flare having a periodic helical shape.

11. A propeller in accordance with claim 10 wherein said flare comprises a plurality of flare sections.

12. A propeller in accordance with claim 11 wherein said flare comprises a first flare section, a second flare section, and a ramp intermediate said first and second flare sections.

13. A propeller in accordance with claim 12, wherein each said propeller blade has a pitch, and wherein said ramp has a pitch at least about equal to said propeller blade pitch.

14. A propeller in accordance with claim 13 wherein said ramp is aligned with one of said propeller blades.

15. A propeller in accordance with claim 12 further comprising a relief adjacent said ramp, said relief extending from an aft end of said flare toward a fore end of said flare.

16. A propeller in accordance with claim 15 wherein said flare has a first radius measured at said aft end from a center of said flare to an outer diameter of said flare at said ramp, and a second radius measured at said flare aft end from said flare center to an outer diameter of said flare at an edge of said relief opposite said ramp.

17. A propeller in accordance with claim 16 wherein said first radius is greater than said second radius.

18. A propeller in accordance with claim 16 wherein said first radius is greater than a radius measured at said flare fore end from said flare center to an outer diameter of said flare.

19. A propeller in accordance with claim 10 wherein said flare comprises a first flare section, a second flare section, and a third flare section, a first ramp intermediate said first and second flare sections, a second ramp intermediate said second and third flare sections, and a third ramp intermediate said third and first flare sections.

20. A propeller kit comprising a flare ring for being secured to an aft end of a propeller hub, said ring having a periodic helical shape.

21. A propeller kit in accordance with claim 20 wherein said flare ring comprises a plurality of flare sections.

22. A propeller kit in accordance with claim 20 wherein said flare ring comprises a first flare section and a second flare section, a ramp intermediate said first and second flare sections, said ramp extending from said fore end.

23. A propeller kit in accordance with claim 22 further comprising a relief adjacent said ramp, said relief extending from an aft end of said ring toward a fore end of said ring.

24. A propeller kit in accordance with claim 22 further comprising a first radius measured at an aft end of said ring from a center of said ring to an outer diameter of said ring at said ramp, and a second radius measured at said ring aft end from said ring center to an outer diameter of said ring at an edge of said relief opposite said ramp.

25. A propeller kit in accordance with claim 24 wherein said first radius is greater than said second radius.

26. A propeller kit in accordance with claims 20 wherein said flare ring comprises a first flare section, a second flare section, and a third flare section, a first ramp intermediate said first and second flare sections, a second ramp intermediate said second and third flare sections, and a third ramp intermediate said third and first flare sections.

27. A method for assembling a flare ring to a hub of a propeller, the propeller including a plurality of blades having a pitch, the flare ring including a plurality of flare sections and a ramp intermediate adjacent flare sections, said method comprising the steps of:

aligning at least one of the ramps with one of the blades; and securing the ring to an aft end of the propeller hub.

28. A method in accordance with claim 27 wherein the propeller includes three blades, and the flare ring includes three ramps, and wherein aligning at least one of the ramps with one of the blades comprises aligning each ramp with a respective one of the propeller blades.

29. A method in accordance with claim 27 wherein securing the ring to an aft end of the propeller hub comprises welding the ring fore end to the propeller hub aft end.

30. A flare ring for a propeller, said flare ring comprising a fore end, a plurality of flare sections extending from said fore end, each said flare section having a helical cross-sectional shape.

31. A flare ring in accordance with claim 30 wherein said flare ring comprises a first flare section and a second flare section, a ramp intermediate said first and second flare sections, said ramp extending from said fore end.

32. A flare ring propeller in accordance with claim 31 wherein the propeller includes at least one blade having a pitch, and wherein said ramp has a pitch at least about equal to the propeller blade pitch.

33. A flare ring in accordance with claim 32 wherein said ramp is aligned with the propeller blade.

34. A flare ring in accordance with claim 31 wherein further comprising a relief adjacent said ramp, said relief extending from an aft end of said ring toward said fore end.

35. A flare ring in accordance with claim 31 further comprising a first radius measured at an aft end thereof from a center of said flare ring to an outer diameter of said flare ring at said ramp, and a second radius measured at said flare ring aft end from said flare ring center to an outer diameter of said flare ring at an edge of said relief opposite said ramp.

36. A flare ring in accordance with claim 35 wherein said first radius is greater than said second radius.

37. A flare ring in accordance with claim 35 wherein said first radius is greater than a radius measured at said flare ring fore end from said flare ring center to an outer diameter of said flare ring.

38. A flare ring in accordance with claim 30 comprising a first flare section, a second flare section, and a third flare section, a first ramp intermediate said first and second flare sections, a second ramp intermediate said second and third flare sections, and a third ramp intermediate said third and first flare sections.

* * * * *